United States Patent [19]

Hassan

[11] Patent Number: 4,870,788

[45] Date of Patent: Oct. 3, 1989

[54] BUILDING PANELS

[76] Inventor: Melvin Hassan, Apt. 1603, 3303 Don Mills Road, Willowdale, Ontario, Canada, M2J 4T6

[21] Appl. No.: 254,766

[22] Filed: Oct. 7, 1988

Related U.S. Application Data

[63] Continuation-in-part of Ser. No. 149,361, Jan. 28, 1988.

[30] Foreign Application Priority Data

Oct. 20, 1987 [CA] Canada ..... 549697

[51] Int. Cl.[4] ..... E04B 1/00

[52] U.S. Cl. ..... 52/105

[58] Field of Search ..... 52/105

[56] References Cited

U.S. PATENT DOCUMENTS 2,270,419 1/1942 Debo ..... 52/105
2,738,584 3/1956 Parker ..... 33/1
3,468,094 9/1969 Campbell ..... 52/105 X

FOREIGN PATENT DOCUMENTS 2256096 5/1974 Fed. Rep. of Germany ..... 52/105
1127013 9/1968 United Kingdom ..... 52/105

*Primary Examiner*—David A. Scherbel
*Assistant Examiner*—Anthony W. Williams
*Attorney, Agent, or Firm*—Kenneth M. Garrett

[57] ABSTRACT

A drywall sheet is marked on the reverse side thereof with a plurality of bands; the bands are of two different types according to two modular dimensions of the sheet to form two grids, which aid in positioning drywall studs prior to the sheet being secured thereto. The obverse face is marked with two complementary marked grids to assist in positioning screws or other securing means. Preferably the obverse face has screws positioning intervals marked around the bounding edge thereof.

10 Claims, 1 Drawing Sheet

BUILDING PANELS

CROSS REFERENCE TO RELATED APPLICATION

This application is a continuation-in-part of U.S. patent application Ser. No. 149,361 filed Jan. 28, 1988.

FIELD OF INVENTION

This invention relates broadly to building systems. More particularly it relates to drywalling systems or the like, although it is to necessarily restricted thereto.

BACKGROUND OF INVENTION

In drywalling systems, particularly in commercial operations where metal studs are commonly used, an installation of a double sided wall proceeds by first positioning and fixing header and footer channels. A first stud on one lateral edge of the wall will normally be secured to the header and footer channels, and remaining studs are loosely positioned in the channels. A drywall panel, which may typically measure four feet wide by the height of the studs up to about twelve feet, is then screwed to the channels and the first stud by a first operator, working from the obverse side of the panel. A second operator, working from the reverse side, positions the remaining studs successively, while the first operator inserts screws through the panel and stud.

Generally speaking the operators will pre-mark the obverse face of the panel with pencil lines located at modular intervals, usually on sixteen or twenty-four inch centers. The second operator will normally use a scrap of lumber cut to the appropriate length to form a spacer. Disadvantages of this proceedure is that it is time consuming, and that errors in positioning any stud may be repeated in positioning successive studs. In the event that long panels are positioned horizontally on the studs, positioning errors can be appreciable. Specifications normally required that panel retaining screws be inserted into the studs at eight inch intervals along the periphery thereof, and at sixteen inch intervals in the field thereof. Generally the operators will gauge the distance between adjacent screws by eye, and it is often found that fewer screws than are specified are used.

SUMMARY OF INVENTION

It is a broad object of this invention to provide a building panel with indicia on the obverse and reverse surfaces thereof to assist operators in locating and positioning studs and screws.

In accordance with a broad aspect of the invention, a drywall sheet having obverse and reverse faces and a bounding edge therearound is provided with first indicia on the field of the reverse face to facilitate the placement of a stud with respect to the sheet, and with complementary indicia locating on the obverse face to facilitate the placement of securing means such as screws.

Generally speaking the sheet will be rectangular and the indicia on the reverse face may comprise one or more bands which will suitably have a width marginally greater than the flange of the stud to be secured thereto, whereby the band will not be wholly masked by the stud when placed in its designated position, so as to permit a rapid and accurate placement of a stud and a quick visual inspection.

Drywall sheets generally have a width of four feet, and a length which is a multiple thereof, usually two, two and half or three. The sheets may be secured to the studs with their length vertically or horizontally oriented. Accordingly it is preferred that the sheets will have indicia on the obverse and reverse faces that is parallel to each bounding edge i.e. arranged in a grid fashion.

The studs in a drywall are commonly spaced at modular intervals of sixteen inches or twenty-four inches. Preferably the indicia will indicate both modular spacings, the indicia associated with one modular spacing preferably having a characteristic appearance which differs from that associated with the other modular spacing.

Desirably the indicia on the obverse face will comprise discrete markings located along the notional center line of each band and spaced apart along the length thereof by a predetermined distance according to the desired spacing between adjacent screws in the field of the sheet. Where the predetermined distance is equal to the modular spacing of the studs, intersecting grid lines will indicate preferred screw placement.

Also desirably, the markings on the obverse face may be coded in similar manner to the indicia on the reverse face, according to the modular spacing of the studs.

It is also preferred that the obverse face contain indicia thereon adjacent the bounding edges of the panel in the form of discrete markings spaced apart by a predetermined distance to facilitate the accurate positioning of fastening screws about the periphery of the sheet.

My invention will be further described in relation to a preferred embodiment thereof as illustrated in the accompanying drawings wherein.

DESCRIPTION OF THE PREFERRED EMBODIMENT

Figure 1:
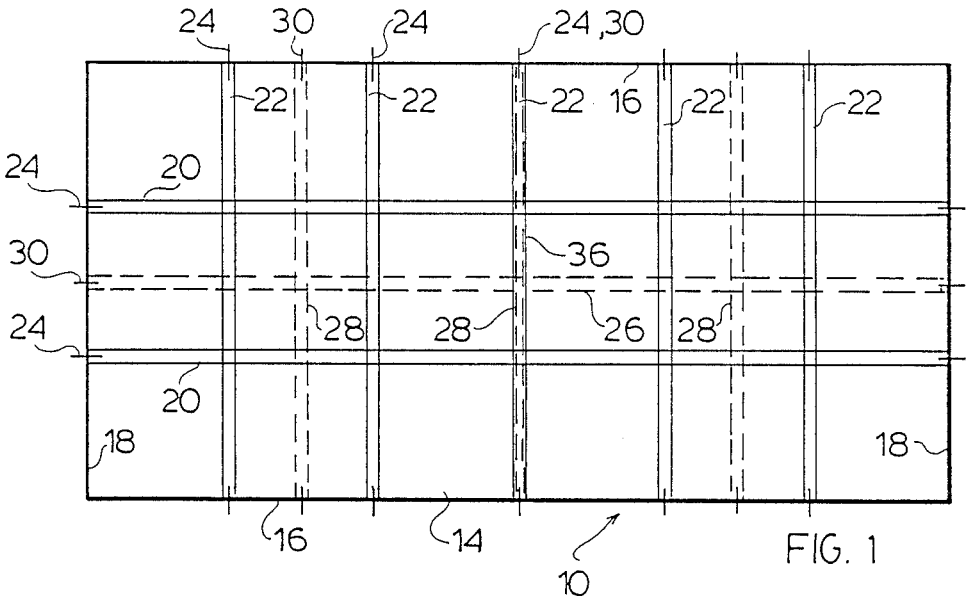
FIG. 1 shows a wall panel from the reverse face thereof in accordance with the invention.

Referring to the drawings in detail, a drywall sheet is identified generally therein by the numeral 10. Sheet 10 has an obverse face 12 and a reverse face 14, and bounding edges 16 along the length thereof and 18 along the width thereof. Sheet 10 is here considered for illustrative purposes to have a length of eight feet and a width of four feet.

Reverse face 14 has marked thereon a first plurality of bands 20 parallel to edge 16 and a second plurality of bands 22 transverse thereto. Each band 20,22 has a similar appearance, here shown by way of example by the longitudinal edges of the bands being delimited by a continuous line. Bands 20,22 each have a notional center line 24 along the length thereof. The center line 24 those of bands 20,22 closest to a parallel edge 16 or 18 are spaced from that edge by a modular distance equal to one third of the width of sheet 10, which is to say in this instance sixteen inches. Adjacent ones of these bands 20,22 are in the field of sheet 10 are also spaced apart by a similar distance between their center lines.

A second grid is seen on reverse face of sheet 10 formed by a band 26 parallel to edge 16, and transverse bands 28, these bands being here shown as delimited along their longitudinal edges by dashed lines. Bands 26,28 have notional center lines 30 along the length thereof, these locating at modular distances of one half the width of sheet 10, or twenty-four inches in this instance. The width of bands 20,22, 26,28 is not critical, but desirably it is marginally greater than the width of the flange of a stud to be positioned against a band, so that edges of the band will be visible along the length of the stud on each transverse side thereof when the stud is accurately positioned relative to the sheet 10. The precise manner of indicating the bands is not critical, and they need not be continuous as here shown for illustrative purposes only. However, given that sheet 10 may often be cut to adjust the length or width or both for particular requirement, where the band markings are discontinuous and widely spaced apart along their length, this may result in the markings being eliminated. It may be remarked that where the bands of both grids are coincident, as at 36, both markings are desirably indicated.

Figure 2:
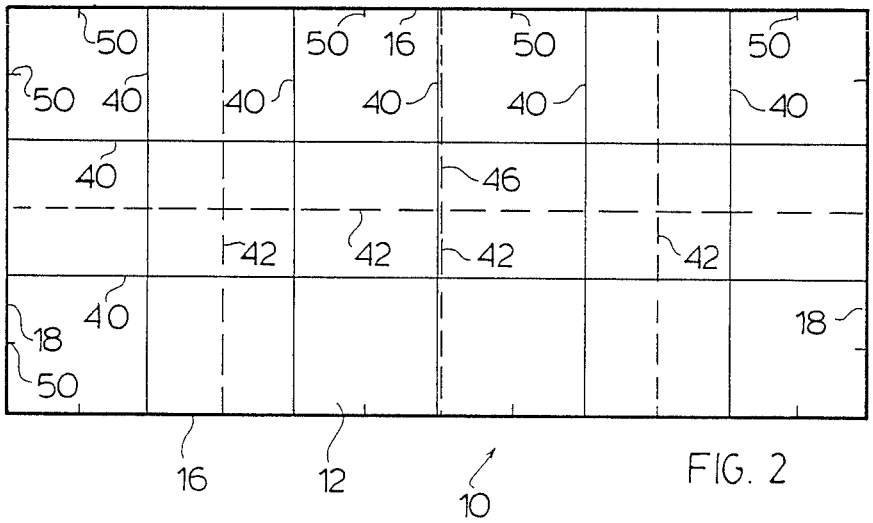
FIG. 2 shows the panel of FIG. 1 from the obverse face thereof.

Considering now the obverse face 12 of sheet 10, one set of markings 40 are located along the notional center lines 24 of bands 20,22 to form a sixteen inch grid, and a second set of markings 42 locate on the notional center lines 30 of bands 26,28 to form a twenty-four inch grid. Suitably grid markings 40 visually relate to the markings on the underlaying grid formed by bands 20,22; similarly grid markings 42 will preferably visually relate to the underlaying grid formed by bands 26,28, as exemplified in FIGS. 1 and 2 herein. Coincident grid lines may conveniently be shown by slightly off setting the lines as at 46.

Obverse face 12 is further provided with a plurality of marks 50 adjacent the bounding edges 16,18 thereof to indicate the preferred position of securing screws; current standards specify crews on about eight inch centers. Grid lines 40,42 while they intersect bounding edges 16,18 will indicate alternate screw placement positions about the periphery of sheet 10. In the field of sheet 10, screw placement positions specified at sixteen inch intervals will be indicated by intersecting grid lines. Where the specified screw placement position is not coincident with the modular stud distance other specific screw placement indicia may be marked on the grid lines.

It will be apparent that many changes to the exemplary embodiment of the invention may be made within the spirit of the invention, and it is intended that all such changes be encompassed in the scope of the claims appended hereto.

I claim:

1. In a drywall sheet having an obverse face, a reverse face, bounding edges and a field extending between said bounding edges, said sheet being intended for securement to a stud framework with at least one stud secured in a field position, the improvement comprising:

indicia locating in the field of said reverse face to indicate the intended position of said stud, and complementary indicia locating on said obverse face to indicate the positioning of screw means for securement of said panel to said stud.

2. A drywall sheet as defined in claim 1, wherein said sheet is rectangular and wherein said indicia on said reverse face comprises at least one band parallel to each bounding edge.

3. A drywall sheet as defined in claim 2, wherein there are a plurality of bands parallel to each bounding edge.

4. A drywall sheet as defined in claim 3, wherein each said bands has a notional center line therealong, and ones of said bands parallel to each said bounding edge are spaced from their respective bounding edges to the center line thereof, by a first modular distance.

5. A drywall sheet as defined in claim 4, wherein others of said bands parallel to each said bounding edge are spaced from their respective edges to the center line thereof by a second modular distance.

6. A drywall sheet as defined in claim 5, wherein said ones of said bands have a first characteristic appearance different to the characteristic appearance of said others of said bands.

7. A drywall sheet as defined in claim 2, wherein each said band has a notional center line therealong, and wherein said indicia on said obverse face are positioned along said notional center lines.

8. A drywall sheet as defined in claim 7, wherein ones of said notional center lines are spaced from associated bounding edge by a first modular distance and others of said notional center lines are spaced apart from said associated bounding edge by a second modular distance, and wherein said discrete markings positioned on said obverse face along said ones of said notional center lines have a first characteristic appearance different to the characteristic appearance of the discrete markings positioned along said other of said notional center lines.

9. A drywall sheet as defined in claim 2, further including discrete markings located on said obverse face adjacent said bounding edges thereof spaced apart at predetermined intervals.

10. A drywall sheet as defined in claim 8, further including discrete markings located on said obverse face adjacent said bounding edge thereof spaced apart at predetermined intervals.

* * * * *